US005331308A

United States Patent [19]

Buccola et al.

[11] Patent Number: 5,331,308

[45] Date of Patent: Jul. 19, 1994

[54] AUTOMATICALLY ADJUSTABLE AND SELF-TESTING DUAL TECHNOLOGY INTRUSION DETECTION SYSTEM FOR MINIMIZING FALSE ALARMS

[75] Inventors: Charles S. Buccola, Valley Stream; Lawrence M. Kolb, Coram, both of N.Y.

[73] Assignee: Napco Security Systems, Inc., Amityville, N.Y.

[21] Appl. No.: 923,103

[22] Filed: Jul. 30, 1992

[51] Int. Cl.[5] ..... G08B 13/19; G08B 13/187

[52] U.S. Cl. ..... 340/522; 340/554; 340/567

[58] Field of Search ..... 340/522, 554, 567

[56] References Cited

U.S. PATENT DOCUMENTS

| | | | |
|---|---|---|---|
| 33,824 | 2/1892 | Johnson | 340/522 |
| 3,074,053 | 1/1963 | McDonough et al. | 340/522 |
| 3,838,408 | 9/1974 | McMaster | 340/501 |
| 4,003,045 | 1/1977 | Stockdale | 367/94 |
| 4,064,509 | 12/1977 | Stockdale | 340/411 |
| 4,090,195 | 5/1978 | Guennou et al. | 342/28 |
| 4,401,976 | 8/1983 | Stadelmayr | 340/522 |
| 4,437,089 | 3/1984 | Achard | 340/541 |
| 4,660,024 | 4/1987 | McMaster | 340/522 |
| 4,710,750 | 12/1987 | Johnson | 340/522 |
| 4,833,450 | 5/1989 | Buccola et al. | 340/506 |
| 4,882,567 | 11/1989 | Johnson | 340/522 |
| 4,942,384 | 7/1990 | Yamauchi et al. | 340/522 |
| 5,077,548 | 12/1991 | Dipoala | 340/522 |
| 5,093,656 | 3/1992 | Dipoala | 340/522 |
| 5,216,410 | 6/1993 | Pildner et al. | 340/522 |
| 5,276,427 | 1/1994 | Peterson | 340/522 |

*Primary Examiner*—Glen R. Swann, III

[57] ABSTRACT

A dual sensor intrusion detection system utilizes adaptive sensor detection techniques to reduce false alarms. The adaptive sensor detection techniques include increasing the stability of one sensor after the other sensor continuously detects motion without confirmation by the first sensor 26 Claims, 5 Drawing Sheets

AUTOMATICALLY ADJUSTABLE AND SELF-TESTING DUAL TECHNOLOGY INTRUSION DETECTION SYSTEM FOR MINIMIZING FALSE ALARMS

BACKGROUND OF THE INVENTION

1. Field of the Invention

The present invention relates to a dual sensor intrusion detection system which utilizes adaptive sensor detection techniques to reduce false alarms.

2. Description of the Related Art

Typically, dual sensor intrusion detection systems include a passive infrared radiation (PIR) detector and a microwave detector, both of which are designed to protect the same volume of space. Most known dual sensor intrusion detection systems continuously operate the PIR detector and the microwave detector in the active mode, i.e., both are capable of detecting an intruder simultaneously. However, in operation, these dual sensing systems have a small false alarm rate which may be improved upon. Typically, this small false alarm rate is the result of two factors either in combination or standing alone. The first factor being a lack of signal processing networks and the second factor being an overall high sensitivity in current dual sensing systems which cannot be modified to respond to disturbances and/or other environmental conditions.

An alternate type of dual sensor intrusion system is one which turns one of the sensors off until the active sensor detects an intruder. As an example, U.S. Pat. No. 4,882,567 to Johnson inactivates the microwave sensor until the PIR sensor detects an intruder. However, this configuration still renders dual sensor intrusion detection systems susceptible to false alarms, in addition to reducing the sensitivity for the overall system.

One approach to improving the detection capabilities of the system has been to increase the sensitivity of one of the sensors after the other has detected an intruder. For example, U.S. Pat. No. 4,437,089 to Achard discloses a dual sensitivity intrusion detection system which increases the sensitivity of a second zone of sensors after the first zone of sensors detects an intruder. However, increasing the sensitivity of the second zone of sensors increases the likelihood of detecting the intruder, but still leaves the intrusion detection systems susceptible to false alarms, especially false alarms caused by disturbances, such as falling objects, rodents, electrical transients, vibrations and/or other environmental conditions, e.g. heat sources.

Therefore, a need exists for dual sensor intrusion detection systems which can operate with only one sensor active, while the other sensor remains inactive, until the active sensor detects motion. Further the need exists for a dual sensor intrusion detection system which reduces false alarms caused by disturbances and/or other environmental conditions within the protected area and which maintains the stability of the system.

SUMMARY OF THE INVENTION

The present invention relates to an intrusion detection system comprising dual sensing means for monitoring motion within a predetermined volume of space. The dual sensing means includes a first sensor for actively detecting motion within the volume of space and a second sensor for passively verifying the motion detected by the first sensor so as to activate an alarm. Processing means is provided to interact with the dual sensing means such that the processing means increases the stability of the second sensor when the first sensor detects motion for a first predetermined period of time without verification by the second sensor. The first sensor for actively detecting motion within the volume of space includes means for modifying the sensitivity thereof when the first sensor detects disturbances for a second predetermined period of time. This means for modifying may either be in single increments or decrements or multiple increments or decrements.

The intrusion detection system of the present invention also include means for multiplexing the signals from the first and second sensors for selective presentation to the processing means. Self-test means are also provided to verify proper operation of the sensors.

A method for detecting an intruder is also disclosed, which comprises detecting a first motion detect signal from a first sensor, verifying the first motion detect signal with a second sensor, and modifying the stability of the second sensor when the first sensor detects motion without verification by the second sensor for a first predetermined period of time and when the first sensor fails to detect motion for a second predetermined period of time.

BRIEF DESCRIPTION OF THE DRAWINGS

Preferred embodiments of the invention are described hereinbelow with reference to the drawings wherein.

DESCRIPTION OF THE PREFERRED EMBODIMENT

Figure 1:
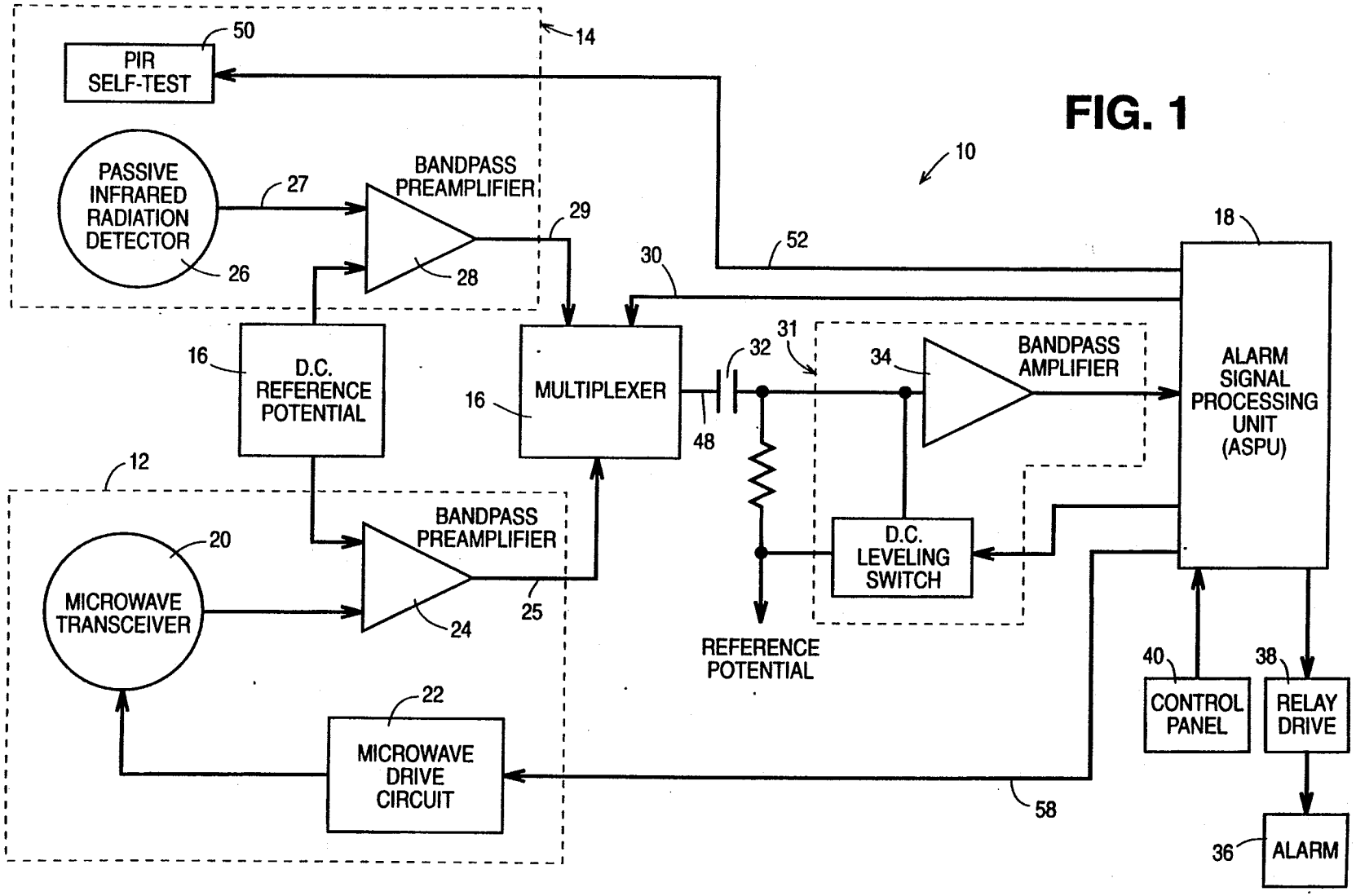
FIG. 1 is a schematic block circuit diagram of the dual sensor intrusion detection system of the present invention.

Referring to FIG. 1, the dual sensor intrusion detection system 10 of the present invention generally includes microwave detection portion 12, passive infrared radiation (PIR) detection portion 14, multiplexer 16, bandpass amplifier network 31 and alarm signal processing unit (ASPU) 18. The dual sensors are provided to protect the same volume of space, such as an office, however, these sensors may be combined with other dual sensors to protect a larger volume of space, such as the entire office building. Therefore, it should be noted that the volume of space discussed herein is the region or area which is to be protected by each dual sensor (hereinafter "the protected area"). It should also be noted that the two types of sensors are discussed as a microwave transceiver and a PIR sensor. The microwave transceiver is an active detector and the PIR sensor is a passive sensor. However, other known types of active detectors, e.g., ultrasonic detectors, and other known types of passive sensors, e.g., pressure or vibration responsive sensors, are contemplated.

The microwave detector portion 12 includes microwave transceiver 20, microwave drive circuit 22, and microwave bandpass preamplifier network 24. Microwave transceiver 20 radiates microwave signals towards the protected area and receives the return microwave signals from the protected area. Microwave transceivers are known in the art and are typically comprised of Gunn diodes. The microwave signal is generated by microwave drive circuit 22 which, under the control of ASPU 18, causes microwave transceiver 20 to oscillate at a predetermined frequency, preferably 10 GHz.

Continuing to refer to FIG. 1, the return microwave signal reflected from the protected area is received by microwave transceiver 20, filtered and amplified by microwave bandpass preamplifier network 24. From network 24 the detected microwave signal is then transferred to multiplexer 16 for selective distribution to ASPU 18 via capacitor 32 and bandpass amplifier network 31. The detected signal from network 31 is presented to ASPU 18 in the form of pulses. These pulses are then counted by ASPU 18 to determine whether an intruder is detected. Typically, an intruder is considered to be detected when the reflected microwave signal is shifted from the carrier in a frequency range between about 5 Hz and about 100 Hz, i.e., the doppler shift is between 5 Hz and 100 Hz. Generally, a frequency shift of 5 Hz equates to about 9 pulses.

Figure 2:
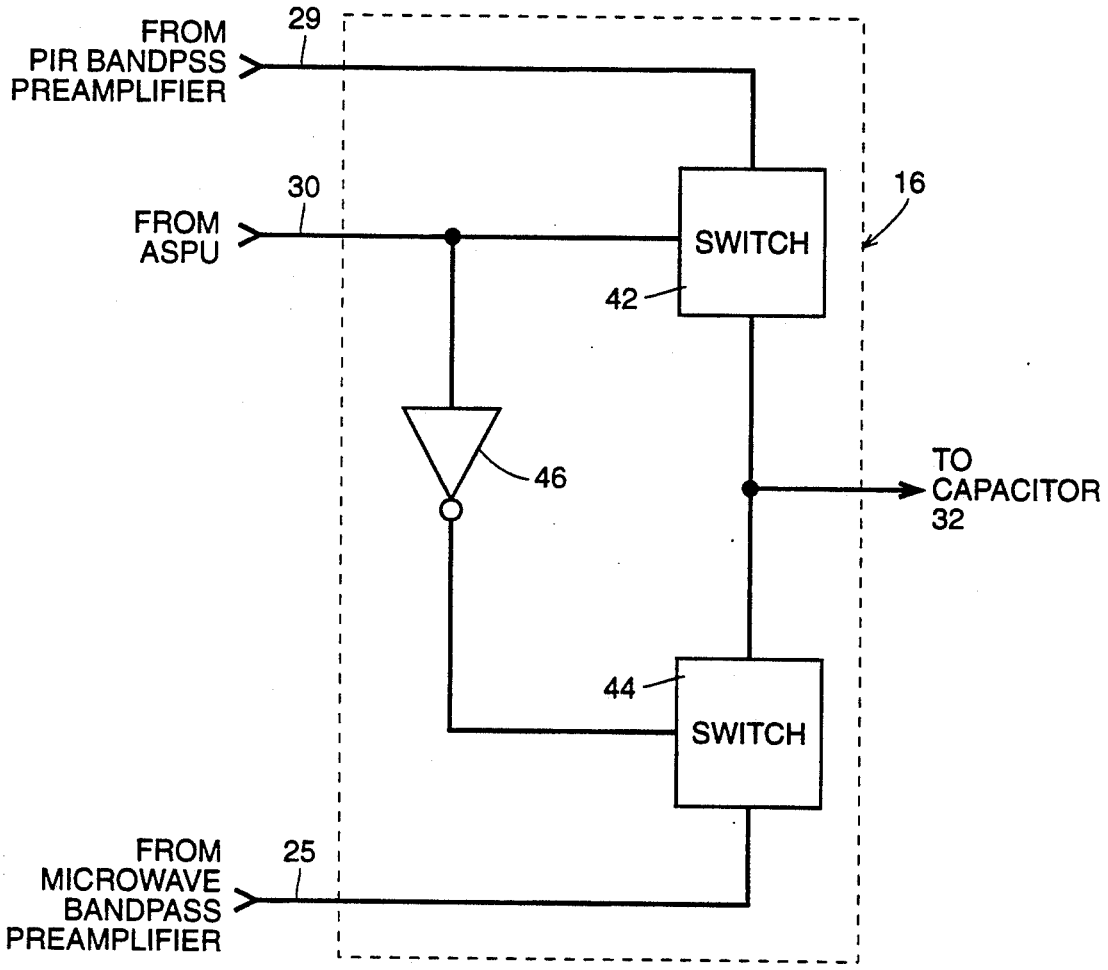
FIG. 2 is a schematic block diagram of the multiplexer of the intrusion detection system of FIG. 1.

ASPU 18 controls multiplexer 16 via control line 30 so that multiplexer 16 causes either the PIR detection signal or the microwave detection signal to be presented through capacitor 32 and bandpass amplifier network 31 to ASPU 18 for processing. Preferably, as shown in FIG. 2, multiplexer 16 includes two switches 42 and 44 which can be configured to multiplex analog or digital signals. To illustrate, invertor 46 is connected between switch 44 and control line 30 such that switch 44 is disabled when switch 42 is enabled and switch 44 is enabled when switch 42 is disabled. As a result, the detection signals from PIR detection portion 14 and microwave detection portion 12 are multiplexed onto line 48. An example of a suitable switch is the CD4066 Quad Bilateral Switch, manufactured by National Semiconductor Corp.

Referring again to FIG. 1, PIR detection portion 14 of intrusion detection system 10, includes PIR sensor 26, PIR bandpass preamplifier network 28 and PIR self-test network 50. PIR sensors are known in the art to passively detect heat or motion within the protected area. Typically, PIR sensor 26 divides the protected area into zones, preferably twenty eight zones, each adjacent zone representing either a positive zone or a negative zone and arranged such that the polarity of the zones alternate. When an intruder or other object crosses a predetermined number of zones, PIR sensor 26 generates a detection signal along line 27. For example, when a positive or a negative zone is crossed, one pulse is generated as the detected PIR signal, i.e., the pulse count is one. To detect an intruder, ASPU 18 must receive from PIR detection portion 14 a predetermined number of pulse counts within a predetermined period of time (the timing window). The pulse count and timing window affect the stability and the accuracy of PIR detection portion 14 and are established by ASPU 18. To illustrate, the preferred PIR detection stability requirements range between a detection mode wherein the PIR pulse count is two pulses and the PIR timing window is five seconds, and a detection mode wherein the PIR pulse count is five pulses and the PIR timing window is thirty seconds.

In the normal detection mode the preferred PIR pulse count and the PIR timing window are at their minimums. As a result, false alarms caused by disturbances and/or other environmental conditions are at a maximum. Whereas, in the high stability detection mode the PIR pulse count and the PIR timing window are at their maximum. As a result, the risk of false alarms caused by disturbances and/or other environmental conditions are minimized. Therefore, as will be discussed in more detail below, when microwave detection portion 12 detects motion for a continuous predetermined period of time without verification by PIR detection portion 14, the motion detected by microwave detection portion 12 is likely to be a false alarm caused by disturbances and/or other environmental conditions. The intrusion detection system will then compensate for the disturbances by increasing the stability of PIR detection portion 14 to minimize transmission of a false alarm.

Referring again to FIG. 1, the PIR detection signal, on line 27, is filtered and amplified by PIR bandpass preamplifier network 28 and then transferred to multiplexer 16 via line 29 for selective distribution to ASPU 18, as discussed above.

ASPU 18 generally includes a microprocessor, memory and a stored program for controlling the operation of the microprocessor, all of which are known in the art. Preferably, ASPU 18 is a Z86C08 microcontroller manufactured by Zilog, Inc.

Continuing to refer to FIG. 1, PIR self-test network 50 is provided to verify the operation of PIR detection portion 14, multiplexer 16 and bandpass amplifier network 31. Self-test is also provided to verify the operation of microwave detection portion 12 in combination with multiplexer 16 and bandpass amplifier network 31. However, the microwave self-test utilizes the existing circuitry associated with microwave detection portion 12. If during the operation of intrusion detection system 10, either microwave detection portion 12 or PIR detection portion 14 fail self-test, a trouble signal is initiated.

In the preferred embodiment, PIR self-test network 50 includes a resistor which is energized by ASPU 18 after approximately twelve hours of inactivity of PIR detection portion 14. Heat generated from the resistor radiates towards PIR sensor 26 causing the sensor to activate, i.e., send a detection signal along line 27. Multiplexer 16 is configured to allow transmission of the detection signal along line 48 for presentation to ASPU 18 in the same manner as discussed above. ASPU 18 then determines the gain of PIR detection portion 14 by tracking the length of time the heat source, e.g. the resistor, is on before a given signal level is presented to ASPU 18. This length of time is proportional to the gain of PIR detection portion 14, multiplexer 16 and bandpass amplifier network 31, thereby enabling ASPU 18 to calculate the gain. Preferably, when the dual sensor intrusion detector system of the present invention is installed, ASPU 18 performs the self-test routine over a period of days which enables ASPU 18 to create a database for the gain of the PIR detection portion. ASPU 18 is then able to compare current self-test results to the post installation self-test results instead of pre-programmed self-test values. As a result, the self-test function for PIR detection portion 14 will not be affected by typical production variations which occur when manufacturing PIR sensors.

As noted above, self-test for microwave portion 12 utilizes the existing microwave circuitry. To self-test microwave portion 12, ASPU 18 activates microwave drive circuit 22 so that microwave drive circuit 22 pulse-width modulates microwave transceiver 20. The pulse-width modulated signal is then transferred to microwave bandpass preamplifier 24. The pulse-width modulated microwave signal is configured to represent a return microwave signal which has detected motion. The microwave self-test signal is then processed through multiplexer 16 to ASPU 18 for comparison with a know return signal stored in ASPU 18.

Figure 3:
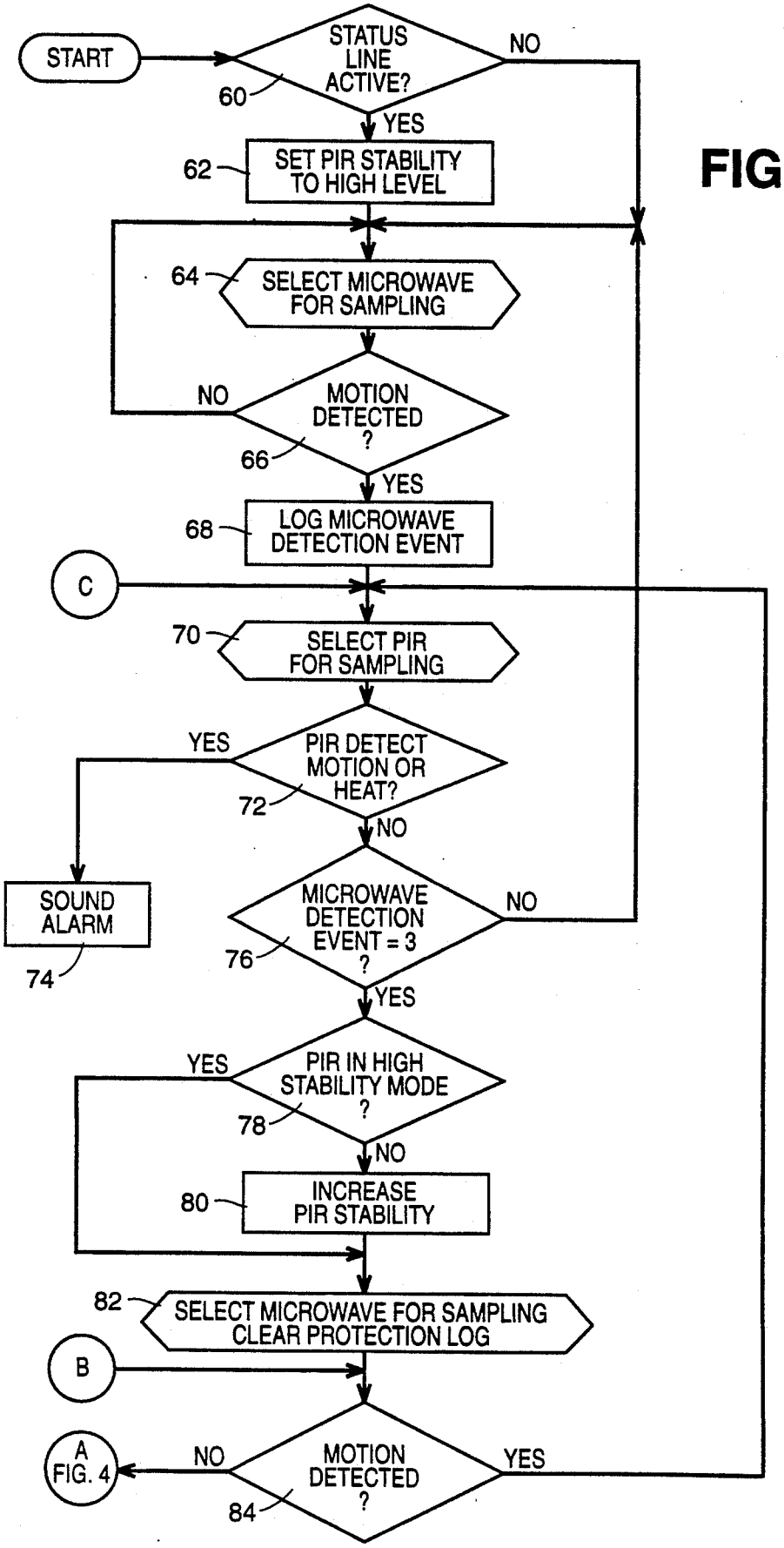
FIG. 3 is a flow diagram of the sensor stability adjustment program for increasing the PIR stability of the intrusion detection system of FIG. 1.

The operational flow of dual sensor intrusion detection system 10 and the PIR stability adjustment will now be discussed with reference to FIGS. 3–5. Initially, as defined in decision block 60 of FIG. 3, ASPU 18 determines whether the status line from control panel 40 is active. An active status line from control panel 40 indicates to ASPU 18 that control panel 40 is in the armed mode. If the status line is active the PIR stability is initially set to the high stability detection mode instead of the normal detection mode, as defined by function block 62.

If the status line is not active or after the PIR stability is initially set to the high stability detection mode, microwave detection portion 12 in combination with ASPU 18 continuously samples the protected area to detect motion therein, as defined by function block 64. Preferably, the sampling rate is 2 KHz, however, the rate may be any rate known in the art sufficient to detect the presence of an intruder. As noted above, an intruder is considered to be detected when the reflected microwave signal is shifted from the carrier frequency in a range of between about 5 Hz and about 100 Hz.

As defined by decision block 66, once microwave detection portion 12 detects motion within the protected area, ASPU 18 responds by logging the microwave detection event. See function block 68. Switching multiplexer 16 then enables the PIR detection signal from PIR detection portion 14 to be presented to ASPU 18. See function block 70.

As defined in decision block 72 and function block 74, if PIR detection portion 14 detects heat or motion within the same protected area, alarm 36 is activated by ASPU 18 in combination with relay driver 38, shown in FIG. 1. It should be noted that alarm 36 includes any alarm known in the art. For example, the alarm may be an audible indicator, a visual indicator, and/or a telephone link to a desired location.

On the other hand, if PIR detection portion 14 does not detect motion or heat, microwave detection portion 12 and PIR detection portion 14 are alternately re-sampled, as shown by decision blocks 72 and 76. As defined by decision blocks 76 and 78, if after a predetermined nun%her of consecutive samples of both portions, preferably three, microwave detection portion 12 continues to detect the motion and PIR detection portion 14 fails to detect (or verify) the motion, the PIR detection stability (the pulse count and timing window) will be increased to a predetermined level in function block 80. The PIR pulse count and PIR timing window will be increased unless the PIR stability is in the high stability detection mode in which case the program will proceed to function block 82 for continued sampling of the microwave detection portion.

Once the PIR stability has been increased, ASPU 18 clears the microwave detection event log and selects microwave detection portion 12 to again determine if motion has been detected by microwave detection portion 12, as defined by function block 82 and decision block 84. If microwave detection portion 12 continues to detect motion the sequence of steps discussed above are repeated until the PIR stability is in the high stability detection mode.

Figure 4:
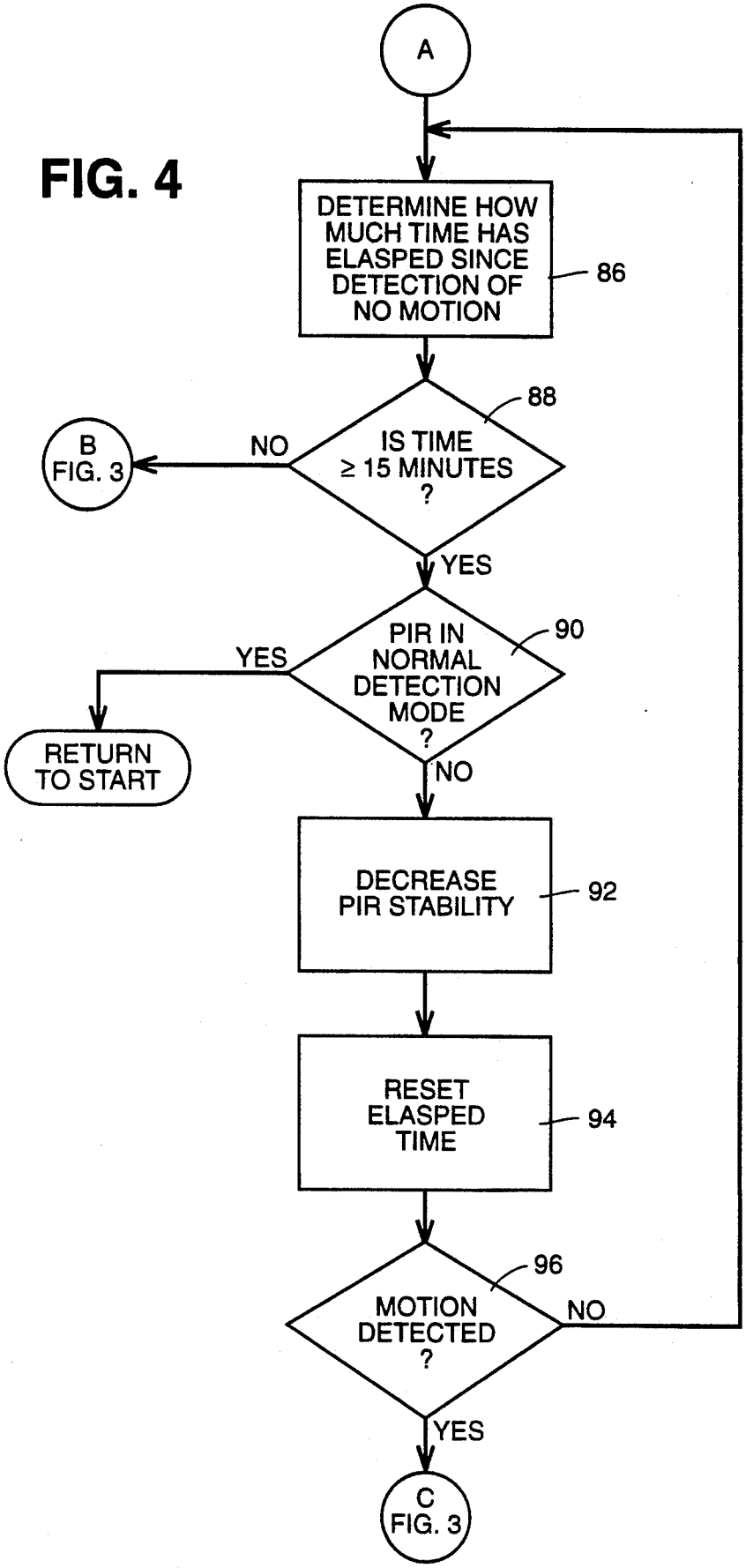
FIG. 4 is a flow diagram of the sensor stability adjustment program for decreasing the PIR stability of the intrusion detection system of FIG. 1.

Turning to FIG. 4, when the PIR stability has been increased the intrusion detection system continues to monitor the microwave detection portion 12 for motion within the protected area. If no motion is detected by microwave detection portion 12, as defined by decision block 84 of FIG. 3, the system begins to return the PIR stability back to the normal detection mode. As defined by function block 86 and decision blocks 84 and 88 in FIGS. 3 and 4, microwave detection portion 12 is continuously sampled to determine if motion has been detected by microwave detection portion 12. If no motion is detected for a predetermined period of time, preferably fifteen minutes, the PIR stability is decremented one level, in decision block 90 and function block 92. The system repeats the above steps, as defined by function block 94 and decision block 96, until the PIR stability is returned to the normal detection mode. Thereafter, the system monitors microwave detection portion 12 until motion is detected at which time the PIR stability will again be increased accordingly.

Figure 5:
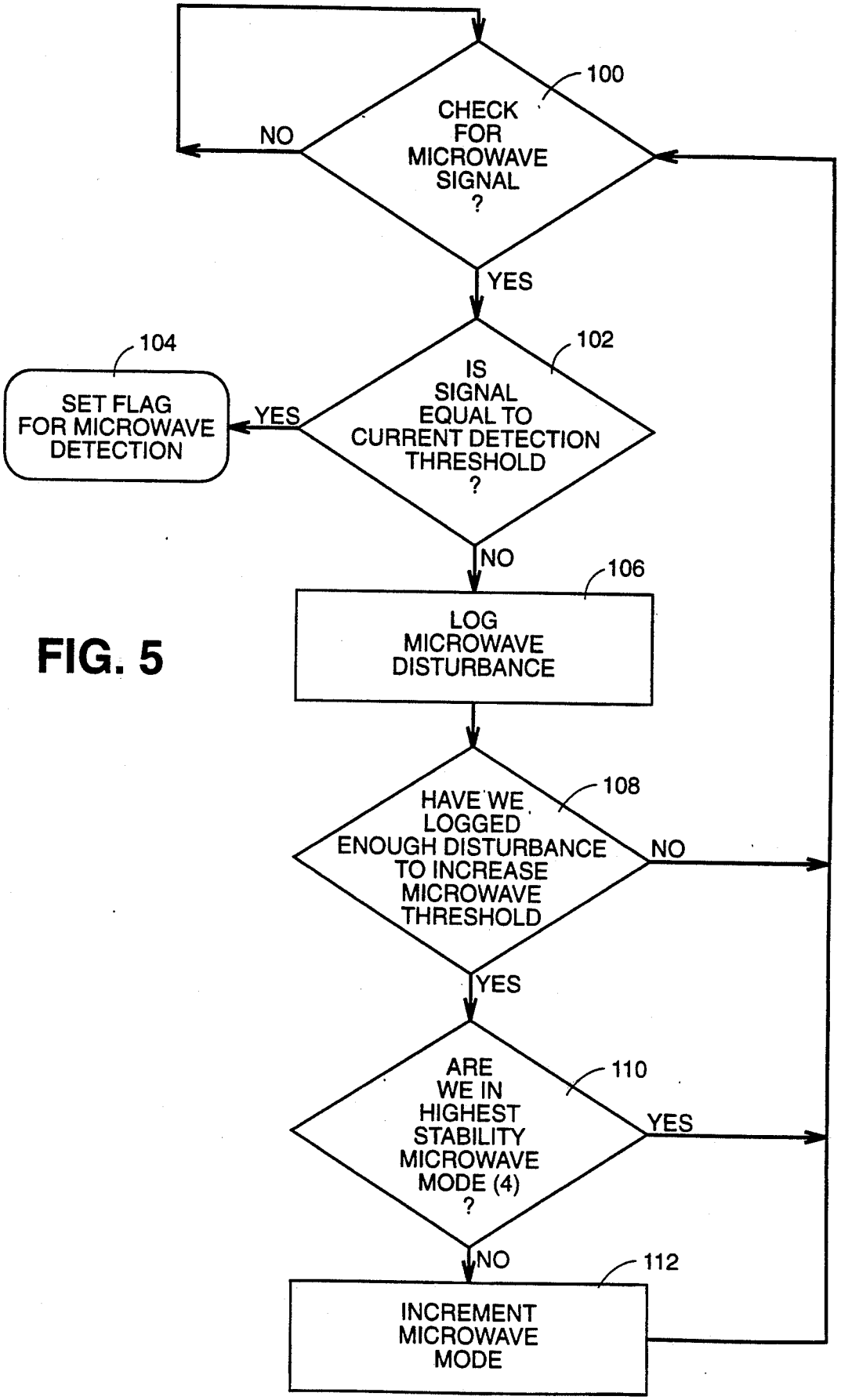
FIG. 5 is a flow diagram of the sensor stability adjustment program for increasing the microwave stability of the intrusion detection system of FIG. 1.

In addition to modifying the stability requirements for PIR detection portion 14, the detection requirements for the microwave detection portion 12 are also modified to minimize the effects of spurious noise signals created by the disturbances and/or other environmental conditions, as shown in FIG. 5. Modification of the microwave detection requirements occurs within decision block 66 and 84, i.e., the determination of when microwave portion 12 detects motion includes the modifications to the microwave detection requirements.

Initially, as shown in decision block 100, the microwave portion continually transmits and receives microwave signals to and from the protected area. Each reflected microwave signal is processed by ASPU 18 to determine if the current predetermined microwave detection threshold has been surpassed, as defined by decision block 102. Preferably, the initial microwave threshold is set for a doppler frequency shift of about 5 Hz.

If the reflected microwave signal is above the threshold, the microwave detection flag will be set within ASPU 18, as defined by function block 104. As a result, the "yes" path from decision blocks 66 or 84 will be followed, as noted above. However, if the reflected microwave signal is below the threshold level, ASPU 18 considers the return signal the result of disturbances and/or other environmental conditions and logs-in the microwave disturbance as shown in function block 106. After a predetermined number of disturbances have been logged, preferably five, the microwave detection threshold is increased, as defined by decision block 108. On the other hand, if an insufficient number of disturbances have been logged the reflected microwave signals are again processed as discussed above.

Once a sufficient number of disturbances have been logged, a determination is made as to whether the microwave stability (i.e. detection requirements for the microwave portion) is in the high stability mode, as defined by decision block 110. Preferably, there are four microwave stability modes which range between a high sensitivity mode wherein the doppler shift of the reflected microwave signal is about 5 Hz and a high stability mode wherein the doppler shift of the reflected microwave signal is about 100 Hz. If the microwave portion is in the high stability mode then the microwave will remain in that mode and continue to sample the reflected microwave signals for motion. If the microwave portion is not in the high stability mode, the stability of the microwave will be increased, as defined by function block 112 and the microwave portion will repeat the above-described sequence. To illustrate, if the doppler shift detected by microwave detection portion 12 averages about 3 Hz (which is below the threshold level and insufficient to place the microwave portion into alarm) ASPU 18 will then shift the frequency range for detecting an intruder to a new predetermined range, such as 8 Hz to 28 Hz. However, it should be noted that the shift in the frequency range does not have to be linearly related to the average doppler shift detected by the microwave portion.

As with the above-described modification techniques for the PIR portion, modification of the stability of the microwave portion also allows the overall intrusion detection system to adapt to environmental conditions within the protected area and reduce the number of false alarms.

It will be understood that various modifications can be made to the embodiments of the present invention herein disclosed without departing from the spirit and scope thereof. Also, various modifications may be made in the configuration of the components. Therefore, the above description should not be construed as limiting the invention but merely as exemplifications of preferred embodiments thereof. Those skilled in the art will envision other modifications within the scope and spirit of the present invention as defined by the claims appended hereto. on as defined by the claims appended hereto.

What is claimed is:

1. An intrusion detection system which comprises:

dual sensing means for monitoring motion within a predetermined volume of space, said dual sensing means having a first sensor for detecting motion within said volume of space and a second sensor for verifying said motion detected by said first sensor so as to activate an alarm; and processing means interactive with said dual sensing means, such that said processing means increases the stability of said second sensor when said first sensor detects motion for a first predetermined period of time without verification by said second sensor, said stability defining when said second sensor activates said alarm.

2. The system according to claim 1, wherein one of said first and second sensors is an active sensor and the other sensor is a passive sensor.

3. The system according to claim 1, wherein said processing means modifies the sensitivity of said first sensor when said first sensor detects a predetermined number of disturbances.

4. The system according to claim 3, wherein said processing means modifies the sensitivity of said first sensor a number of times until said first sensor is in a predetermined maximum stability mode.

5. An intrusion detection system which comprises:

first detecting means for monitoring motion within a predetermined volume of space and for generating a first detect signal in response to detection of motion in said predetermined volume of space;

second detecting means for generating a second detect signal in response to detection of said motion in said predetermined volume of space; and processing means for receiving said first and second detect signals, for activating said second detecting means in response to first detect signal, for modifying the number of said second detect signals required to activate an alarm when said first detecting means detects motion for a predetermined period of time without verification by said second detecting means and for activating said alarm when said modified number of said second detect signal is received by said processing means.

6. The system according to claim 5, further comprising means for multiplexing said first and second detect signals such that said processing means selectively receives said first detect signal and said second detect signal.

7. The system according to claim 5, wherein said processing means modifies the number of said second detect signals by increasing a pulse count and a timing window associated with said second detect signal.

8. The system according to claim 7, wherein said pulse count and said timing window are modified between a normal detection mode and a high stability detection mode.

9. The system according to claim 8, wherein said normal detection mode comprises a pulse count of two pulses and a timing window of five seconds.

10. The system according to claim 8, wherein said high stability detection mode comprises a pulse count of four pulses and a timing window of ten seconds.

11. The system according to claim 8, further comprising means for self-testing said first detecting means and said second detecting means.

12. An intrusion detection system which comprises:

microwave detecting means for monitoring motion within a predetermined volume of space and for generating a first detect signal in response to detection of motion in said predetermined volume of space;

PIR detecting means for generating a second detect signal in response to detection of said motion in said predetermined volume of space; and processing means for receiving said first and second detect signals, for activating said PIR detecting means in response to said first detect signal, for modifying the number of said second detect signals required to activate an alarm when said microwave detecting means detects motion and said PIR detecting means fails to detect motion for a first predetermined period of time, and for activating said alarm when said modified number of said second detect signal is received by said processing means.

13. The system according to claim 12, further comprising means for multiplexing said first and second detect signals such that said processing means selectively receives said first detect signal or said second detect signal.

14. The system according to claim 12, wherein said processing means modifies the number of said second detect signals by increasing a PIR pulse count and a PIR timing window.

15. The system according to claim 14, wherein said PIR pulse count and PIR timing window are modified between a normal detection mode and a high stability detection mode.

16. The system according to claim 15, wherein said normal detection mode comprises a PIR pulse count of two pulses and PIR timing window of five seconds.

17. The system according to claim 15, wherein said high stability detection mode comprises a PIR pulse count of four pulses and a PIR timing window of ten seconds.

18. The system according to claim 14, wherein modifying the number of said second detect signals comprises decreasing said PIR pulse count and said PIR timing window when no motion is detected by said microwave detecting means for a second predetermined period of time.

19. The system according to claim 12, further comprising means for self-testing said microwave detecting means and said PIR detecting means.

20. The system according to claim 19, wherein said self-test means comprises a resistor positioned in close proximity to said PIR detecting means such that heat radiating from said resistor activates said PIR detecting means.

21. The system according to claim 19 wherein said self-test means comprises pulse-width modulating said microwave detecting means.

22. A method for detecting an intruder, comprising:

detecting a first motion detect signal from a first sensor;

verifying said first motion detect signal with a second sensor; and modifying the stability of said second sensor when said first sensor detects motion without verification by said second sensor for a first predetermined period of time and when said first sensor fails to detect motion for a second predetermined period of time.

23. The method of according to claim 22 further comprising modifying the sensitivity of said first sensor when said first sensor detects motion a predetermined number of times.

24. The method according to claim 23, wherein the sensitivity of said first sensor is modified a number of times until said first sensor is in a predetermined maximum mode.

25. The method according to claim 22, wherein said stability of said second sensor is increased when said first sensor detects motion without verification by said second sensor for said first predetermined period of time.

26. The method according to claim 22, wherein said stability of said second sensor is decreased when said first sensor fails to detect motion for said second predetermined period of time.

* * * * *